US006849793B2

(12) United States Patent
Okamoto et al.

(10) Patent No.: US 6,849,793 B2
(45) Date of Patent: Feb. 1, 2005

(54) DRUM ACOUSTIC WIRE ASSEMBLY AND A DRUM USING THE SAME

(75) Inventors: Tomio Okamoto, Hamamatsu (JP); Shigehiro Okamoto, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 10/392,568

(22) Filed: Mar. 20, 2003

(65) Prior Publication Data

US 2003/0177884 A1 Sep. 25, 2003

(30) Foreign Application Priority Data

Mar. 22, 2002 (JP) ..... 2002-080624

(51) Int. Cl.[7] ..... G10D 13/02
(52) U.S. Cl. ..... 84/415; 84/417
(58) Field of Search ..... 84/415, 411 R, 84/417, 22; 273/158

(56) References Cited

U.S. PATENT DOCUMENTS 6,044,885 A * 4/2000 Kato ..... 152/540
6,091,010 A * 7/2000 Gauger ..... 84/415
6,093,877 A * 7/2000 Nickel ..... 84/415

FOREIGN PATENT DOCUMENTS

JP 58-50372 11/1983

* cited by examiner

*Primary Examiner*—Kimberly Lockett
(74) *Attorney, Agent, or Firm*—Koda & Androlia

(57) ABSTRACT

An acoustic wire assembly mounted on a drumhead, including a plurality of acoustic wires disposed parallel to each other so as to be brought into contact with and moved away from the drumhead in which at least some of the acoustic wires are polygonal (square, pentagonal, hexagonal and octagonal) in cross-section, and they can be in a coil shape or a straight shape.

5 Claims, 3 Drawing Sheets

DRUM ACOUSTIC WIRE ASSEMBLY AND A DRUM USING THE SAME

BACKGROUND OF THE INVENTION

1. Field of the Invention

The present invention relates to a drum acoustic wire assembly used in drum sets, marching drums, concert drums, etc. and more particularly to a drum acoustic wire assembly used in snare drums and to a drum that uses the same.

2. Prior Art

A snare drum, for instance, is designed so that a special acoustic effect that imparts the musical instrument a peculiar light tone color known as "pattering" by way of selectively causing a drum acoustic wire to come into contact with and then separate from the drumhead and thus transmitting the vibration of the drumhead to the drum acoustic wire. Japanese Utility Model Application Publication No. 58-50372, for instance, discloses a structure for mounting such a drum acoustic wire.

The acoustic wire assembly of this prior art includes a plurality of acoustic wires (or snares) arranged with suitable spaces in between and are held at the ends by retaining members. Differences in the shape of the acoustic wires or differences in their materials can result in an extremely wide range of variations in sounds.

As to the differences in shape of wires used in acoustic wire assemblies, there are generally two types: acoustic wires produced by winding the wires into a coil, and acoustic wires in a form of straight wires. As to the materials, a great many different types of materials are used for acoustic wires, including steel, stainless steel, copper-based metal and other non-ferrous metal, and nylon, aramid fibers and other synthetic resins.

The cross sectional shape of acoustic wires is not always circular when the wires are made of synthetic resin fibers or wires (those that are twisted); however, metal acoustic wires basically have a circular cross section of constant diameter for its entire length. Accordingly, as to the conditions of initial contact with drumheads, there are differences between coiled acoustic wires and straight acoustic wires. In coiled acoustic wires, the wires come into contact with a drumhead at points, while the straight acoustic wires make a line contact with a drumhead. Thus, the manner of contact between a drumhead and acoustic wires vary depending upon the shape (coiled or straight (non-coiled)) of the acoustic wires. However, regardless of such type of acoustic wires, the contact state of the wires is substantially the same for its entire length in coiled wires or straight wires as long as the wires have a circular cross section; and therefore, with the circular cross sectional acoustic wires, the acoustic characteristics of pattering sound are the same on any point of the wires, and such characteristics are monotone and unattractive. Here, the "acoustic characteristics" of pattering sound comprise sound level, frequency elements which the pattering sound involves, damping characteristics of pattering sound and so on.

The percussive sound made by a drumhead and acoustic wires is proportional to the amount of contact of wires of an acoustic wire assembly with a drumhead. Accordingly, in order to increase the volume of percussion sound in an acoustic wire assembly that has acoustic wires with a circular cross section, it is necessary to increase the amount of contact by way of increasing the length the acoustic wires and/or the number of the acoustic wires.

SUMMARY OF THE INVENTION

The present invention solves the problems seen in the prior art drum acoustic wire assembly.

It is an object of the present invention to provide an acoustic wire assembly and a drum with such an acoustic wire assembly, in which different acoustic characteristics of pattering sound can be obtained at different contact locations (of the wires with the drumhead) and the volume of percussive sound made by the drumhead and acoustic wires can be enhanced with an increased amount of contact between the drumhead and the acoustic wires, without increasing the number or length of the acoustic wires.

The above object is accomplished by a unique structure of the present invention for an acoustic wire assembly that includes a plurality of slender acoustic wires (snares) which are disposed parallel to each other and come into contact with and move away from a drumhead; and in the present invention, at least some of the acoustic wires have a polygonal cross sectional shape.

With the above unique structure, the wires with a polygonal cross section have an increased amount of contact with a drumhead since they make surface contact in addition to point or line contact.

The "polygonal" shape includes square, pentagonal, hexagonal, octagonal, etc.

In the acoustic wire assembly according to the present invention, each of the wires is formed in a coil shape.

In this structure, the drumhead and the wires come into contact at point, line and surface in the initial state of contact with a drumhead, the "initial state" being the state before the drumhead makes vibrations (by being struck).

In addition, each of the wires of the acoustic wire assembly can be a straight wire.

When the wires are straight, they come into line or surface contact in the initial state of contact with a drumhead.

The present invention further provides a drum equipped with the acoustic wire assembly described above.

In such a drum, since the drum is equipped with an acoustic wire assembly that includes acoustic wires with a polygonal cross section, the amount of contact between the drumhead and the acoustic wires in the initial state of contact is large, which yields more percussive sound compared to the prior art acoustic wire assembly that has the same number and length of acoustic wires of the acoustic wire assembly of the present invention.

DETAILED DESCRIPTION OF THE INVENTION

The present invention will now be described in detail with reference to the embodiments illustrated in the accompanying drawings. The embodiments will be described on a snare drum in which the acoustic wire assembly is mounted on the bottom-side drumhead in such a that the wires of the acoustic wire assembly are selectively moved to come into contact with and to be separated from the drumhead of the snare drum.

Figure 1:
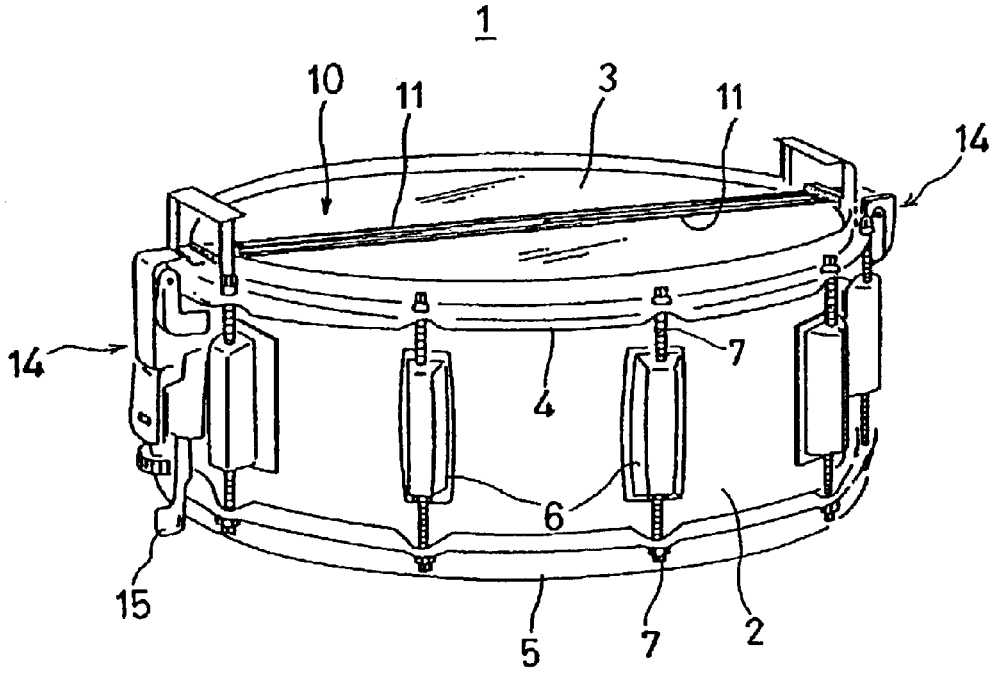
FIG. 1 is an exterior perspective view of a snare drum equipped with the acoustic wire assembly according to the present invention.

The snare drum 1 shown in FIG. 1 comprises a cylindrical drum main body 2 which is open at both ends. The top-side (percussion side) drumhead (not shown) and the bottom-side (non-percussion side) drumhead 3 are respectively stretched over the openings at both ends of the drum main body 2. The drumheads are formed from a natural leather which is the hide of an animal or from a synthetic resin film such as polyester, polycarbonate, etc. The outer circumferential edge portions of the drumheads are respectively held by annular head frames. The head frames are mounted on the outer circumferences of the openings of the drum main body 2, and they are respectively covered by annular tightening frames 4 and 5.

The tightening frames 4 and 5 are respectively connected to a plurality of lugs 6, which are attached to the outer surface of the drum main body 2, via tightening bolts 7. The tension of the respective drumheads is adjusted by rotating the tightening bolts 7 so that the two tightening frames 4 and 5 are caused to approach or move away from each other. When the tightening bolts 7 are tightened so that the tightening frames 4 and 5 are moved toward the middle portion (in the axial direction) of the drum main body 2, the tightening frames 4 and 5 press against the head frames of the respective drumheads and cause the head frames to move toward the middle portion of the drum main body 2. As a result, the tension of the respective drumheads increases. Conversely, when the tightening bolts 7 are loosened, the pressing force of the tightening frames 4 and 5 on the head frames decreases, and thus the tension of the drumheads decreases.

A drum acoustic wire assembly 10 is mounted on the surface of the bottom-side drumhead 3. The drum acoustic wire assembly 10 is comprised of a plurality of (10 to 30) slender acoustic wires 11 and two band-equipped wire holding plates 12A and 12B that hold both ends of each one of the acoustic wires 11. The acoustic wires 11 are lined up at a fixed spacing (e.g., 2.9 mm) on the same plane in the direction perpendicular to the axial line of each wire.

Figure 2:
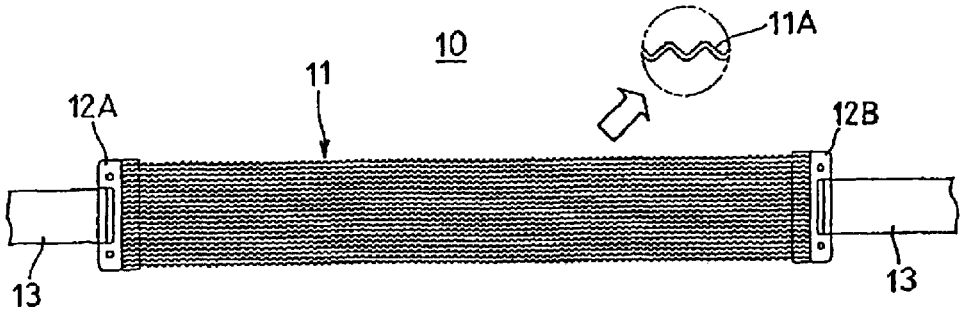
FIG. 2 is a top view of the acoustic wire assembly of the present invention that includes coiled acoustic wires.
Figure 3:
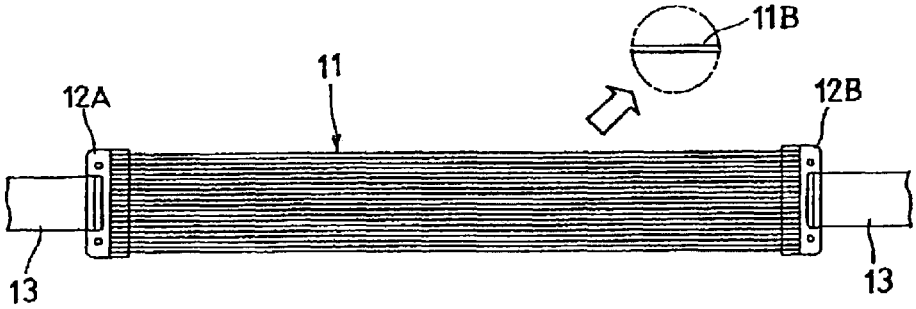
FIG. 3 is a top view of the acoustic wire assembly of the present invention that includes straight acoustic wires.

In the embodiment shown in FIG. 2, each of the acoustic wires 11 is a coiled wire 11A (see the enlarged wire 11A in the circle). The acoustic wires are not limited to coiled wires, and each of them can be a straight wire 11B as shown in FIG. 3 (see the enlarged wire 11B in the circle).

The acoustic coiled and straight wires 11A and 11B are made of steel, stainless steel, or nylon, aramid, or other type of synthetic resins. The diameter of each acoustic wire is about 0.5 to 1.2 mm. The wires can be twisted.

Figure 4:
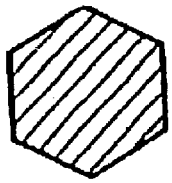
FIG. 4 shows the cross section of one of the acoustic wires of the present invention.

The cross sectional shape of each of the wires 11A and 11B is regular hexagonal as shown in FIG. 4; however, it can be square, pentagonal, octagonal or other polygonal shape. In other words, the acoustic wire assembly 10 according to the present invention includes polygonal acoustic wires 11A or 11B instead of acoustic wires having a circular cross section. In the acoustic wire assembly 10 of the present invention, some of the polygonal acoustic wires 11A or 11B can be replaced with wires having a circular cross sectional shape. In other words, the acoustic wire assembly 10 can be comprised of polygonal cross-sectional acoustic wires and circular cross-sectional acoustic wires used together. Thus, in the present invention, at least one acoustic wire of the acoustic wire assembly 10 has a polygonal cross section.

In use, the drum acoustic wire assembly 10 having the structure described above is mounted on the bottom-side drumhead 3 in the same manner as a conventional drum acoustic wire assembly. In other words, the bands 13 attached to the wire holding plates 12A and 12B of the drum acoustic wire assembly 10 are connected to a strainer 14 which are provided on the diametrically opposite sides from each other on the outer circumference of the drum main body 2.

When not in use, the drum acoustic wire assembly 10 is held in a non-contact state in which the wires 11 of the drum acoustic wire assembly 10 are not in contact with the drumhead 3.

At the time of use, the acoustic wires 11 of the drum acoustic wire assembly 10 are set to contact with the surface of the drumhead 3 by being moved toward the drumhead 3 by the operation of a lever 15 of the strainer 14. Accordingly, when the top-side drumhead (not shown) of the drum is struck with the wires 11 being in contact with the bottom-side drumhead 3, the vibration of the top-side drumhead is transmitted to the acoustic wires 11 via the bottom-side drumhead 3, and the special acoustic effect of a light tone color known as "pattering", which is peculiar to the instrument, is produced.

In the above acoustic wire assembly 10, the acoustic wires 11 are the coiled or straight acoustic wires 11A or 11B that have a polygonal cross sectional shape. Accordingly, the amount of contact of the wires 11 with the drumhead 3 is greater than that of the conventional acoustic wire assembly that includes wires 16 that have a circular cross sectional shape as shown in FIGS. 7A and 7B.

Figure 7A:
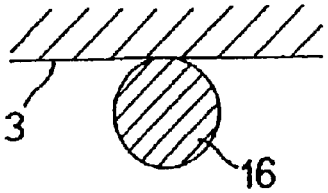
FIG. 7A PRIOR ART
FIG. 7A shows an initial state of contact between a drumhead and a circular cross sectional acoustic wire.
Figure 7B:
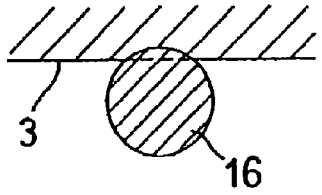
FIG. 7B PRIOR ART
FIG. 7B shows the state in which the circular acoustic wire has sunken into the drumhead.

More specifically, when the conventional coiled wires 16 with a circular cross section are used, the initial state of contact with the drumhead 3 is entirely point contact as shown in FIG. 7A.

Figure 5A:
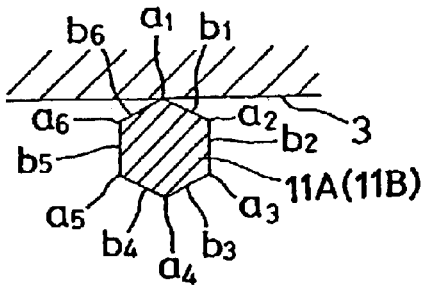
FIG. 5A shows an initial state of contact between a drumhead and a hexagonal cross sectional acoustic wire.
Figure 6A:
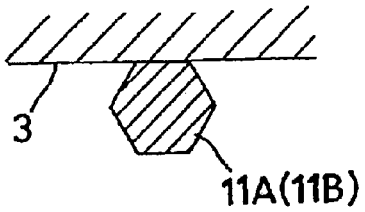
FIG. 6A shows another initial state of contact between a drumhead and a hexagonal cross sectional acoustic wire.

On the other hand, when the coiled acoustic wires 11A with a hexagonal cross section are used, since each wire, as shown in FIG. 5A and FIG. 6A, has six corners a1 to a6 and six plane surfaces b1 to b6, the corners and the plane surfaces successively come into contact in the initial state of contact with the drumhead 3, making point, line and surface contacts, thus having an increased amount of contact with the drumhead 3 compared to the wire 16 shown in FIG. 7A. Accordingly, the volume of percussive sound is greater than that obtained by the wire 16, and this greater volume of percussion sound is produced without increasing the number or length of the acoustic wires 11A.

Furthermore, when the straight wires 11B with a hexagonal cross section shown in FIG. 3 are used, they make line or surface contact in their initial state of contact with the drumhead 3. In other words, when a corner of wire 11B is in line contact with the drumhead 3, as shown in FIG. 5A, the amount of contact is almost the same as with the conventional straight acoustic wires that have a circular cross section. However, when the straight wire 11B makes surface contact with its plane surface, as shown in FIG. 6A, there is a significant increase in the amount of contact of the wires with the drumhead.

In other words, with the straight acoustic wires 11B, the volume of sound can be selected by varying the initial state of contact with the bottom drumhead 3. When the corners of the wires 1B are in contact with the drumhead, the volume of sound is roughly the same as the conventional acoustic wires 16 having a circular cross sectional shape. However, when the surface contact is made with its plane surface of the wire 11B, then there is an increase in the amount of contact, and the volume of sound is greater than that obtained by wire 16, and this greater amount of volume of sound is produced without increasing the number or length of the wires 11B.

Also, in the case of coiled acoustic wires 11A, point and line contact states are involved in addition to surface contact due to the shape of the wires 11A. Accordingly, different acoustic characteristics of pattering sound are produced for each contact point of the wires with the drumhead, which affords a special acoustic effect with a different sound from that in the prior art.

With the straight acoustic wires 11B, the slenderness thereof ensures both sensitivity (good response) and volume of the sound.

Figure 5B:
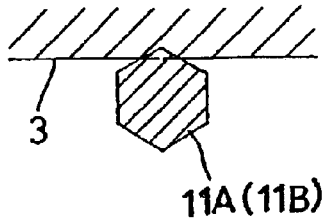
FIG. 5B shows the state in which the hexagonal acoustic wire has sunken into the drumhead.
Figure 6B:
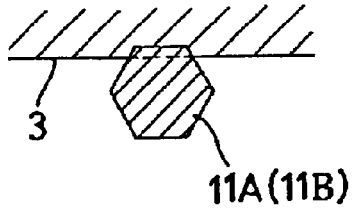
FIG. 6B shows the state in which the hexagonal acoustic wire has sunken into the drumhead.

FIGS. 5B, 6B and 7B show the state of contact of the acoustic wire when the drumhead is struck.

The drumhead 3 has elasticity. Thus, when drumhead 3 in the initial state of contact shown in FIGS. 5A, 6A and 7A is vibrated, the wires 11A (11B) and 16 bite into the drumhead 3, the state of contact changes to those as shown in FIGS. 5B, 6B and 7B. More specifically, there is less depression in FIG. 5B, which shows the acoustic wire 11A (11B) of the present invention bit into the drumhead with its corner, than in FIG. 7B, which shows the acoustic wire 16 of the prior art; and there is more depression in FIG. 6B, which shows the acoustic wire 11A (11B) of the present invention bit into the drumhead with its plane surface, than in FIG. 5B, which shows the acoustic wire 16 of the prior art.

In other words, in the acoustic wires 16 having a circular cross sectional shape, no matter where the contact with the drumhead is, the amount of depression is constant. However, in the acoustic wires 11 (11A, 11B) with a polygonal cross sectional shape, the contact thereof with the drumhead can be varied in many different manners. The amount of depression has an effect on the acoustic characteristics of pattering sound of the acoustic wires 11. In other words, a shallower depression has a smaller effect on the acoustic characteristics of pattering sound, while a deeper depression has a larger effect on the acoustic characteristics of pattering sound. Also, when the acoustic wires 11 are coiled wires 11A and straight wires 11B with a polygonal cross sectional shape, the initial state of contact varies as discussed above, and the acoustic characteristics of pattering sound are not constant, and a wide variety of acoustic characteristics of pattering sound are produced (resulting in a richer sound).

The amount of depression of the acoustic wires can vary in many steps by way of changing the manner of attaching the wires 11 (11A, 11B) and by way of twisting the wires 11 (11A, 11B). Also, a similar effect can be obtained when the acoustic wires of a polygonal cross sectional shape are given a three-dimensional structure as in the coiled wires 11A or when they are given a two-dimensional structure as in a straight shape or an undulating (zigzag) shape, for instance.

The inventors of the present application conducted tests on the acoustic wire assembly of the present invention that has steel acoustic wires of a hexagonal cross-section and on the acoustic wire assembly of prior art having steel acoustic wires of a circular cross section. The test results show that the drum acoustic wire assembly with hexagonal cross section acoustic wires produces higher level (dB) of sound in high note range compared to the wire assembly having circular cross sectional acoustic wires. Particularly in high frequency range of 3000 Hz or above, the drum acoustic wire assembly having hexagonal cross sectional wires shows higher dB values than the wire assembly having circular cross sectional acoustic wires. Accordingly, the acoustic wire assembly of the present invention produces clearer and more vivid and richer sound compared to the prior art acoustic wire assembly.

As seen from the above, the acoustic wire assembly and the drum that uses such an acoustic wire assembly according to the present invention are designed such that acoustic wires having a polygonal cross sectional shape are used. Thus, in the initial state of contact with a drumhead, the coiled acoustic wires of a polygonal cross sectional shape make a surface contact with the drumhead in addition to point and line contact, and the straight acoustic wires of a polygonal cross sectional shape make a line or surface contact. Therefore, the wires of the acoustic wire assembly of the present invention with polygonal cross section wires have an increased amount of contact with and different types of contact (point, linear and surface contacts) with a drumhead than acoustic wires having a circular cross sectional shape; and this increased amount of contact and different types of contact are obtained without increasing the number wires or the length of the wires, and a greater percussive volume (sound) is produced. Also, since the acoustic wires a polygonal cross sectional shape make point, line and surface contacts with a drumhead, and since the manner of contact is thus at random, different acoustic characteristics of pattering sound are obtained and special performance effects with different sounds can be produced.

What is claimed is:

1. An acoustic wire assembly comprising a plurality of acoustic wires disposed parallel to each other so as to be moved into contact with and away from a drumhead, wherein at least one of said plurality of acoustic wires is formed from a wire with a polygonal cross section.

2. The acoustic wire assembly according to claim 1, wherein said each of said wires is formed in a coil shape.

3. The acoustic wire according to claim 1, wherein each of said wires is formed in a straight shape.

4. A drum provided with said acoustic wire assembly according to claim 1, 2 or 3.

5. An acoustic wire assembly comprising a plurality of acoustic wires disposed parallel to each other so as to be moved into contact with and away from a drumhead, wherein said plurality of acoustic wires comprise wires of a polygonal cross section and wires of a circular cross section.

* * * * *